United States Patent [19]

Cagle

[11] 4,073,602

[45] Feb. 14, 1978

[54] VACUUM PRODUCING DEVICE

[75] Inventor: Harlan R. Cagle, Cheboygan, Mich.

[73] Assignee: Sahlin International Inc., Birmingham, Mich.

[21] Appl. No.: 676,082

[22] Filed: Apr. 12, 1976

[51] Int. Cl.[2] ..... F04F 5/52

[52] U.S. Cl. ..... 417/185; 294/64 A; 417/193

[58] Field of Search ..... 417/182, 185, 192, 193, 417/184; 294/64 A, 64 B

[56] References Cited

U.S. PATENT DOCUMENTS

| | | | |
|---|---|---|---|
| 284,614 | 9/1883 | Colvin | 417/185 |
| 1,032,222 | 7/1912 | Locke | 417/193 |
| 1,345,639 | 7/1920 | Schmidt | 417/185 |
| 2,381,589 | 8/1945 | Hayes | 417/182 X |
| 2,767,727 | 10/1956 | Acomb | 417/184 X |
| 2,975,958 | 3/1961 | Kane | 417/185 X |
| 3,052,479 | 9/1962 | LaTrell | 417/185 X |
| 3,568,959 | 3/1971 | Blatt | 294/64 A |

*Primary Examiner*—William L. Freeh
*Assistant Examiner*—Edward Look
*Attorney, Agent, or Firm*—Harness, Dickey & Pierce

[57] ABSTRACT

A vacuum producing device comprises a venturi unit which functions to produce or stop producing a vacuum after predetermined movement of a surrounding sleeve and air shut off member and includes silencing means for substantially reducing the sound of pressure air passing through the device.

18 Claims, 3 Drawing Figures

VACUUM PRODUCING DEVICE

RELATED APPLICATIONS

This is related to my U.S. application Ser. No. 577,407, filed May 14, 1975, (now U.S. Pat. No. 3,967,849), which in turn was a continuation of my U.S. application Ser. No. 369,861, filed June 14, 1973 (now abandoned), and which in turn was a continuation of my U.S. application Ser. No. 147,322, filed June 27, 1971 (now abandoned).

BRIEF SUMMARY OF THE INVENTION

It is the purpose of this invention to provide an efficient, adjustable, and relatively quietly operating device for attachment to a vacuum cup or the equivalent for producing vacuum and non-vacuum conditions in the cup in response to the pressure of air flowing through the device.

The invention accomplishes this purpose by a combination of fixed and movable sleeves, the fixed sleeve carrying a venturi unit that is continuously connected through communicating passages in the sleeves to the cup and the movable sleeve carrying an air shut off valve member and operating against an adjustable spring in response to the pressure of air supplied to the device to unseat or seat the valve and thereby control the flow of air through the fixed sleeve and thus through the venturi. Air that flows through the fixed sleeve is subjected to various sound attenuating mechanisms so that for a device of this type it is relatively quiet when it is finally exhausted. The adjustable spring enables it to be used over a relatively wide range of line pressures, e.g., about 40 to 120 p.s.i.

DESCRIPTION OF THE INVENTION

Figure 1:
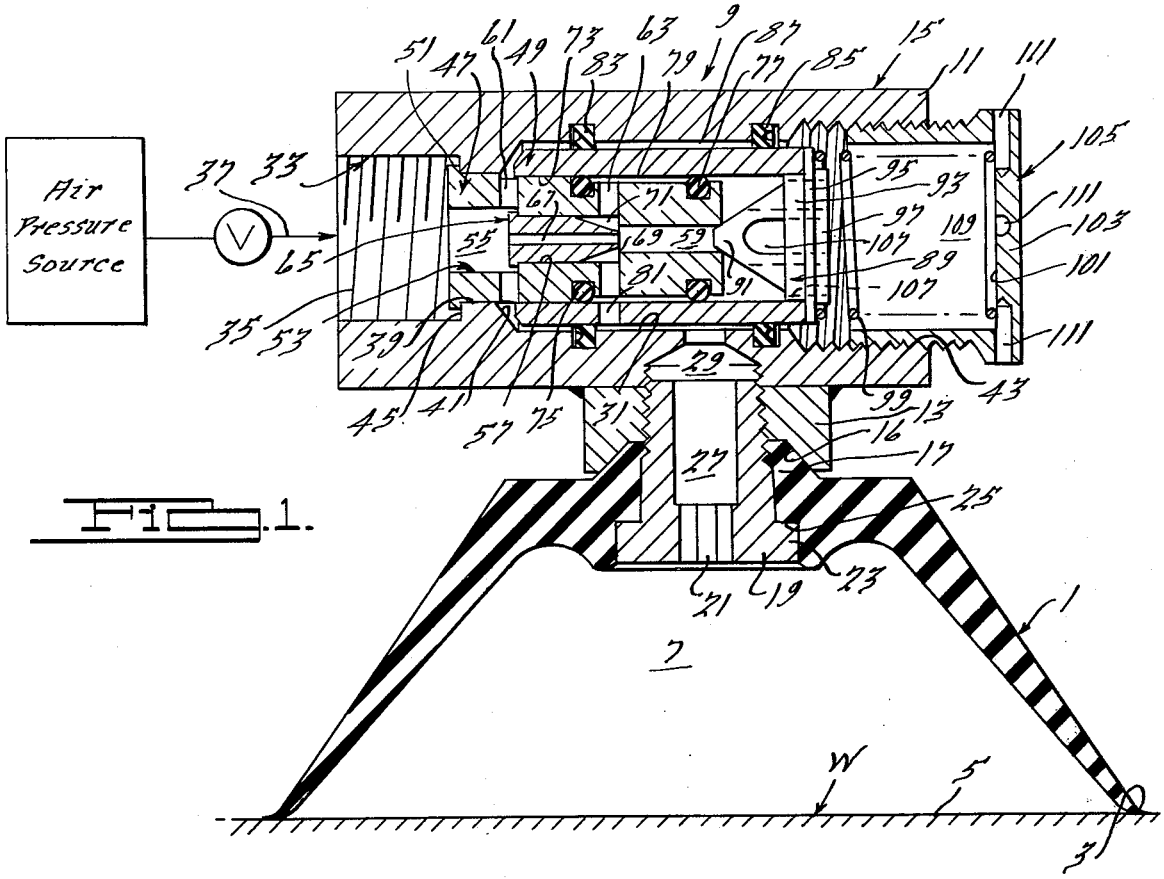
FIG. 1 is a cross section through a vacuum producing device and vacuum cup embodying the invention with the schematic addition of a pressure source and control valve.
Figure 2:
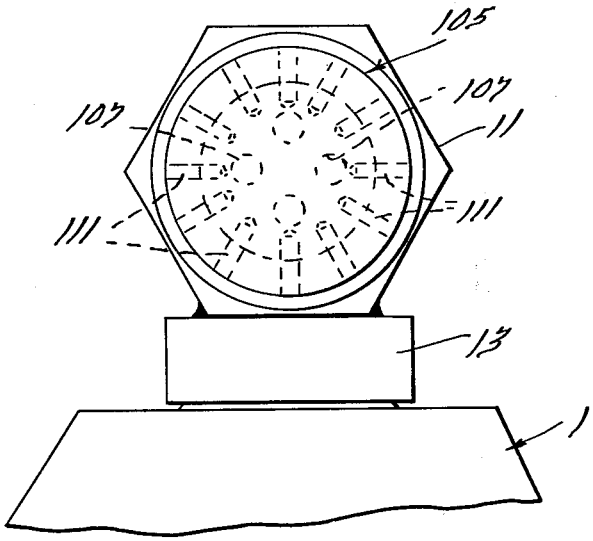
FIG. 2 is a side elevation taken from the right of FIG. 1.
Figure 3:
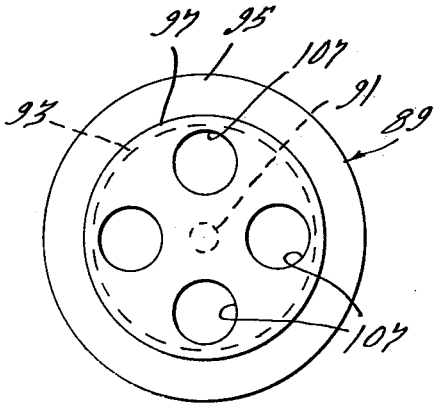
FIG. 3 is an enlarged detail elevation of the air shut off valve member as taken from its right hand end in FIG. 1.

A vacuum cup 1 is shown with its bottom lip 3 in operative contact with the surface 5 of a workpiece W to be lifted or moved by means of a suitable arm or other mechanism (not shown) that supports the cup 1. The pressure condition in the chamber 7 inside of the cup 1, i.e., whether there is a vacuum condition, a blow-off condition, or simply an ambient pressure condition, is controlled by the vacuum producing device of this invention. This device includes a hexagonal body 11, preferably of metal bar stock that is commercially available, with a circular mounting block 13 secured thereto forming the housing 15 for the device. The block 13 is recessed at 16 to receive the top portion 17 of the cup 1. A hollow fitting 19 which receives a hex wrench at opening 21 is threaded into the block 13 and has an annular shoulder 23 that engages a surface 25 in the cup 1 whereby the latter is tightly secured to the housing 15. The opening 21 connects with opening 27 in the fitting and this connects with enlarged opening 29 in the housing which includes a smaller, uniform diameter drilled portion that opens through the wall of the central section 31 of a longitudinal cylindrical bore 33 that is coaxial with the body 11. From left to right, the bore 33 includes a threaded inlet section 35 for attachment to a pressure air conduit (shown schematically at 37), a smaller diameter, relatively short section 39, a frusto-conical section 41 between the section 39 and the previously mentioned section 31, and then terminates at its right end in threaded section 43. A radial shoulder 45 connects the inner end of section 35 to the smaller section 39.

Disposed in bore 33 and coaxial with it are a fixed inner sleeve 47 and a movable outer sleeve 49 that moves longitudinally or telescopically with respect to the fixed sleeve. The fixed sleeve 47 is press fitted in the housing 15 and supported by bore section 39 and has a flange 51 seated against shoulder 45. It has a bore 53 extending through it, forming an air passage, consisting of three sections 55, 57, and 59 of progressively smaller diameter and it terminates inside of the outer sleeve 49. A plurality of radial passages 61 connect the downstream end of the bore section 55 to the outside of the fixed sleeve; and a plurality of radial passages 63 connect the downstream end of bore section 57 to the outside of the fixed sleeve. A venturi unit 65 is press fitted in the bore section 57, having a radial flange seating against the radial shoulder between the bore sections 55 and 57. The venturi plug has a small straight through air passage 67 and a tapered downstream end nose which terminates at the upstream end of bore section 59 and is slightly smaller in diameter than the bore section so as to form an annular aspirating passage 69 around the outer end of the venturi which connects the bore 59 to the annular space 71 in bore 57 around the tapered end of the venturi.

The outer sleeve 49 is preferably shaped as shown and made of a low friction material (such as TEFLON) so that its upstream section which is in contact with the outer surface of fixed sleeve 47, as seen at 73, will slide easily on it. Downstream of the slide joint 73, the fixed sleeve is reduced slightly in outer diameter so as to be out of contact with the outer sleeve and has an annular O-ring groove just upstream of radial passages 63 and another annular O-ring groove at its downstream end, these grooves containing respectively the O-rings 75 and 77 which provide a seal between the two sleeves that preserves the pressure condition in the annular chamber 79 between the rings 75 and 77 so that it is responsive to the pressure in passages 63 and/or to the pressure in a plurality of radial passages 81 through the wall of outer sleeve 49. The outer sleeve itself is slightly smaller in diameter than section 31 of bore 33 and a pair of annular grooves in the wall of section 31 contain outwardly facing V-seals (or O-rings) 83 and 85 that preserves the pressure condition in the annular chamber 87 between the seals 83 and 85 so that it is responsive to the pressure in passages 81 and/or the opening 29 leading to the vacuum cup chamber 7.

It will now be seen that the cup chamber 7 is connected in the following way to air passage 59: passage 21 to passage 27 to passage 29 to annular chamber 87 to radial passages 81 to annular chamber 79 to radial passages 63 to annular tapered space forming vacuum chamber 71 to aspirating opening 69 and finally to passage 59.

The flow of air through passage 59 is under the control of a shut off valve 89 which has a frusto-conical nose 91 that enters the end of the passage 59 and when in the position shown in FIG. 1 will block flow through it. In such a position any air flowing into the device will be forced to flow into the cup chamber 7 by route set forth in the preceding paragraph. The nose 91 of valve 89 diverges into a cylindrical section 93 that slidably fits in the end of the outer sleeve 49. Next to this valve has a flange 95 that abuts the end face of the outer sleeve to limit the extent to which the valve can enter into the sleeve. The right end of the valve 89 has a cylindrical spring centering portion 97 around which one end of coil spring 99 fits, the other end engaging the inner face 101 of the end wall 103 of an externally threaded cup-shaped cap 105 which is screwed to a desired degree into the threaded section 43 of the housing. The body of the valve 89 downstream of the nose portion 91 which closes off the bore 59 is shaped to permit air to flow by or through it, preferably by means of a plurality of passages 107, such as the four equally spaced and sized straight round holes illustrated. These holes plus any substantial separation of the valve 89 from the end of the sleeve 49 permit air to flow into the relatively large chamber 109 inside of the cap 105. The end wall 103 and the adjacent side-wall portion of the cap 105 have a large number of radially extending air exhaust passages 111 formed therein which are located so that the inner ends of the passages break through the inner face 101 of the end 103 to permit air to enter the passages. Such air then flows radially outwardly to leave the device 9 in a diffused flow pattern that is perpendicular to the axis of the body 11.

With the device and its parts in the position of FIG. 1, no vacuum is being produced. Assuming then that the valve V is opened to permit air to flow from the pressure source through conduit 37 into bore 33 and into bore 53 of the fixed sleeve 47, there will still be no vacuum unless the air pressure is high enough to unseat the valve 89 from the end of passage 59. During such low air pressure conditions, the incoming air will flow into the chamber 7 via the passages and chambers 69, 71, 63, 79, 81, 87, 29, 27, and 21, respectively. The incoming air pressure acts in two ways to unseat the valve 89. First, it acts on the cross sectional area of the valve nose 91 in passage 59. Second, it acts through passages 61 to reach the annular chamber at the left end of the movable sleeve 49 where it exerts a pressure on the annular cross section of the sleeve which is longitudinally transmitted to the valve flange 95 tending to unseat it. Until the pressure does increase to the amount required to unseat the valve, air will blow-out the passages and chambers enumerated above and clean them out and will also blow across the surface 5 to clean it off. The length of the blow-off period depends upon the applied pressure in line 37 and upon the valve seating pressure applied by spring 99, which is, of course, adjustable by means of the screw cap 105.

In connection with the initial unseating of the valve 89 two additional points are to be noted. First, by making the sleeves of different materials as indicated above so that joint 73 is low friction, the break-away time is minimized. Second, the O-ring 75 prevents air pressure from reaching chamber 79 and the pressure condition and location of this chamber is independent of motion of sleeve 49.

Continuing with the operation of the device, when the valve 89 is finally cracked open, air from passage 59 will expand into the full cross sectional area of the interior of sleeve 49 which will have a pronounced sound energy absorbing and sound attenuating effect. Further attenuation occurs as the air enters the four reduced diameter passages 107 and again expands into chamber 109. Still further attenuation occurs as the air impinges against wall face 101 and changes flow direction to move at right angles toward passages 111 and even further attenuation occurs as the air enters the very small diameter passages 101 and then expands into the atmosphere as it leaves the cap 105. The net effect of these many acoustic mechanisms is a low decibel rating for a device of this type and a favorable exit air diffusion, i.e., 360° radial instead of a straight axial jet.

As the air flows down passages 67 and 59 it draws air into its flow stream in accordance with Bernoulli's principle from chamber 71 via the small annular opening 69 thereby creating a vacuum condition, i.e., air in chamber 7 flows via passages and chambers 21, 27, 29, 87, 81, 79, 63, 71, and 69 into passage 59 so that the chamber 7 is at less than atmospheric pressure whereby the cup 1 is tightly and continuously held against the surface 5 with a pressure differential sufficient to enable the cup to perform its intended function e.g., lift or move the workpiece W. Thus, the cup 1 is made operative by the flow of air through device 15 at sufficient pressure to unseat valve 89. It may be noted that once the valve is cracked open air pressure will have the greater area of the valve's entire cross sectional area within sleeve 49 to facilitate further opening.

To render the device 15 inoperative and cause the cup 1 to release the workpiece W, the air flow to the device is either terminated or reduced below the level required to keep the valve 89 unseated. The parts are arranged so that nose 91 always seats in the end of passage 59 before the left end of sleeve 49 bottoms out (contacts) frusto-conical surface 41. In the illustrated preferred embodiment of the invention the sleeve length is such that it doesn't bottom out at all but remains spaced from surface 41 and the spring load is transmitted by the valve 89 into fixed sleeve 47. The advantage of having the valve 89 bottom out before the sleeve 49 is that this will immediately stop the production of vacuum and cause what air pressure there is in passage 53 to flow into the chamber 7 and blow it off the part W thereby giving a very fast separation of the cup 1 from the workpiece W. It is to be noted that because of the differences in valve areas exposed to pressure (nose 91 versus full cross section), the air pressure must drop very substantially below the pressure required to unseat. For example, if 80 psi is required to unseat and start vacuum production, it is preferable for the pressure to drop to around 60 psi before the valve closes to stop vacuum production. This prevents inadvertent release as a result of normal fluctuations in air pressure in line 37. The degree to which the adjustable cap 105 is screwed to compress the spring 99 is a cricical factor in the valve time to seat and the time of blow-off after vacuum cutoff.

Modifications may be made in the specific structure illustrated without departing from the spirit and scope of the invention.

I claim:

1. A vacuum producing device comprising a housing having an inlet means for pressurized air and an outlet means for pressurized air, said housing having a chamber adjacent said outlet means, a first passage in said housing providing for flow of pressurized air from said inlet to said chamber, venturi means supported in the housing in said first passage between said inlet means and chamber and including a vacuum chamber, said housing including a vacuum outlet and passage means continuously connecting said vacuum outlet to said vacuum chamber, a movable member supported in said housing and defining a wall of said vacuum passage means and having a surface thereon exposed to pressurized air on the upstream side of the venturi means, a valve positioned upon seating to close the end of said first passage and thereby prevent flow of pressurized air to said chamber and the production of vacuum by said venturi means, said movable member being operatively connected to said valve so that movement of said member as a result of sufficient pressure thereon from said pressurized air provides for unseating of the valve to permit air to flow through the first passage to produce vacuum by said venturi means, and spring means in the housing urging the valve to a seated position to close the first passage.

2. A device as set forth in claim 1 including air silencing means in said chamber comprising passageways of alternating large and small cross section for the flow of air from said first passage out of said outlet means.

3. A device as set forth in claim 2 wherein certain of said silencing passageways are formed in said valve.

4. A device as set forth in claim 3 wherein said housing includes an end cap and said outlet means is in said end cap.

5. A device as set forth in claim 4 wherein said outlet means comprises a multiplicity of passages in the end cap extending at substantially right angles to said first passage and of reduced diameter to form a part of said silencing means.

6. A device as set forth in claim 5 wherein said cap has an end wall extending at substantially right angles to said first passage and said multiplicity of passages are in said end wall.

7. A device as set forth in claim 6 wherein said spring means is confined between said end wall of the cap and said valve.

8. A device as set forth in claim 7 wherein the end cap is adjustably secured to said housing to enable the axial distance between said end wall and the end of the first passage to be varied whereby the initial compression of the spring may be adjusted.

9. A device as set forth in claim 1 wherein said movable member comprises a sleeve surrounding said venturi means and movable along the length of the first passage and having at least one passage therein forming a part of said passage means.

10. A device as set forth in claim 9 wherein said member surface comprises the upstream end of the sleeve.

11. A device as set forth in claim 10 wherein the length of said sleeve is such that said sleeve end is continuously exposed to the pressure of air on the upstream side of the venturi means.

12. A device as set forth in claim 9 wherein said valve has a frusto-conical nose located inside the downstream end portion of the sleeve and a radial flange seating against the downstream end face of the sleeve.

13. A device as set forth in claim 9 including a fixed sleeve mounted in said housing and providing said first passage.

14. A device as set forth in claim 1 wherein said housing includes an end cap adjustably secured to said housing, said spring means being confined between said valve and said end cap, adjustment of said end cap serving to adjust the initial setting of said spring means, said end cap having an end wall extending at substantially right angles to the first passage and including a multiplicity of small passages extending substantially at right angles to said first passage and connecting said chamber to the outside of said device and providing said outlet means and serving to attenuate sound in air leaving the housing.

15. A vacuum producing device comprising a housing having an inlet means for pressurized air and an outlet means for pressurized air, said housing having a chamber adjacent said outlet means, a first passage in said housing providing for flow of pressurized air from said inlet to said chamber, venturi means supported in the housing in said first passage between said inlet means and chamber and including a vacuum chamber, said housing including a vacuum outlet and passage means continuously connecting said vacuum outlet to said vacuum chamber, a movable member supported in said housing and having a surface thereon exposed to pressurized air on the upstream side of the venturi means, a valve positioned upon seating to close the end of said first passage and thereby prevent flow of pressurized air to said chamber and the production of vacuum by said venturi means, said movable member being operatively connected to said valve so that movement of said member as a result of sufficient pressure thereon from said pressurized air provides for unseating of the valve to permit air to flow through the first passage to produce vacuum by said venturi means, and spring means in the housing urging the valve to a seated position to close the first passage, said movable member comprising a movable sleeve surrounding said venturi means and movable along the length of the first passage and having at least one passage therein forming a part of said passage means, and pairs of spaced annular seal means respectively engaging the inner and outer surfaces of the movable sleeve and defining chambers forming parts of said passage means.

16. A vacuum producing device comprising a housing having an inlet means for pressurized air and an outlet means for pressurized air, said housing having a chamber adjacent said outlet means, a first passage in said housing providing for flow of pressurized air from said inlet to said chamber, venturi means supported in the housing in said first passage between said inlet means and chamber and including a vacuum chamber, said housing including a vacuum outlet and passage means continuously connecting said vacuum outlet to said vacuum chamber, a movable member supported in said housing and having a surface thereon exposed to pressurized air on the upstream side of the venturi means, a valve positioned upon seating to close the end of said first passage and thereby prevent flow of pressurized air to said chamber and the production of vacuum by said venturi means, said movable member being operatively connected to said valve so that movement of said member as a result of sufficient pressure thereon from said pressurized air provides for unseating of the valve to permit air to flow through the first passage to produce vacuum by said venturi means, and spring means in the housing urging the valve to a seated position to close the first passage, said movable member comprising a movable sleeve surrounding said venturi means and movable along the length of the first passage and having at least one passage therein forming a part of said passage means, a fixed sleeve mounted in said housing and providing said first passage, said fixed sleeve having first openings extending at substantially right angles to said first passage and serving to connect the upstream side of the venturi means to the upstream end of the movable sleeve.

17. A device as set forth in claim 16 wherein said fixed sleeve has an upstream outer surface that as a sliding fit with the movable sleeve at the upstream end portion of the movable sleeve, said fixed sleeve having an outer surface downstream of said upstream outer surface that is spaced from the inner surface of the movable sleeve to provide an annular space between the two sleeves, a pair of spaced annular seal means engaging both the fixed sleeve and the movable sleeve and extending across said annular space to define a first annular chamber forming a part of said passage means, said fixed sleeve having at least one passage extending at right angles to said first passage and opening into said first annular chamber.

18. A device as set forth in claim 17 wherein said housing has a bore therein and said movable sleeve is located in said bore and has an outer surface spaced from the surface of the bore to define an annular space between them, a pair of spaced annular seal means engaging both the surface of the bore and the outer surface of the movable sleeve and extending across the annular space between them to define a second annular chamber forming a part of said passage means, at least one passage in said movable sleeve continuously opening into both said first and second annular chambers, said vacuum outlet opening into said second annular chamber.

* * * * *